United States Patent [19]

Campbell

[11] Patent Number: 4,894,963

[45] Date of Patent: Jan. 23, 1990

[54] BUILDING KIT

[75] Inventor: Stephen J. Campbell, Carmel, Ind.

[73] Assignee: Heartland Industries, Inc., Carmel, Ind.

[21] Appl. No.: 180,143

[22] Filed: Apr. 11, 1988

[51] Int. Cl.[4] ..... E04B 1/19

[52] U.S. Cl. ..... 52/90; 52/105

[58] Field of Search ..... 52/90, 105

[56] References Cited

U.S. PATENT DOCUMENTS

| | | | |
|---|---|---|---|
| 2,495,966 | 1/1950 | Haines . | |
| 2,880,470 | 1/1950 | Pickersgill . | |
| 2,902,733 | 9/1959 | Justus . | |
| 3,082,492 | 3/1963 | Grubb . | |
| 3,477,184 | 11/1969 | Johnson | 52/105 |
| 4,115,967 | 9/1978 | Kragt | 52/90 |
| 4,527,981 | 7/1985 | Chisum | 446/106 X |
| 4,701,131 | 10/1987 | Hildebrandt | 446/126 X |
| 4,723,382 | 2/1988 | Lalvani | 52/79.4 X |

*Primary Examiner*—David A. Scherbel
*Assistant Examiner*—Anthony W. Williams
*Attorney, Agent, or Firm*—Barnes & Thornburg

[57] ABSTRACT

A building kit is provided for the assembly of a building structure. The kit includes a plurality of building members having selected lengths and configurations. Each building member occupies a designated position in a mating engagement with at least one other companion building member to form the building structure. The building members include coded sections to provide a visual indication of which building members are to be coupled in the mating engagement, thereby facilitating assembly of the building structure. A door frame assembly can be included with the building kit. The door frame assembly includes a plurality of building members having integral connector portions to couple adjacent building members to form the door frame.

3 Claims, 2 Drawing Sheets

BUILDING KIT

BACKGROUND AND SUMMARY OF THE INVENTION

This invention relates to a kit for the assembly of a building structure, and particularly to a kit containing a plurality of building members having coded sections to facilitate assembly of the building structure and to a novel door assembly.

Conventional building assemblies include a plurality of building members of various shapes and sizes. Assembly of these conventional buildings can be difficult, especially to an individual who is not experienced in assembling the buildings. Because different building members have shapes and sizes that are confusingly similar, it can be extremely time consuming to assemble the building according to a predetermined specification.

Door assemblies having X-shaped portions or crossbucks to stabilize an outer frame of the door are also well known in the art. Assembly of doors having these X-shaped portions is often difficult due to problems in properly aligning the X-shaped portion and coupling it to the outer frame.

One object of the present invention is to provide means for coding the building members so that selected building members to be interconnected can be determined by visual inspection.

Another object of the present invention is to provide dovetail means for interconnecting selected building members to form a door so that alignment and connection of the building members is simplified, thereby facilitating assembly of the door.

In accordance with the present invention, a building structure can be assembled from a kit comprising a plurality of precut building members. Each building member includes means for permitting interconnection with at least one selected other building member to form a building structure. Each building member has a predetermined position relative to the remaining building members in the building structure. The present invention also provides coding means located on the building members for indicating the predetermined position of each building member so that the selected building members to be interconnected can be determined by visual inspection to facilitate assembly of the building structure.

In preferred embodiments, the building structure kit includes a plurality of precut wall members or studs and a plurality of precut roof members or rafters. Each stud has a predetermined location in the building structure to form an outer border defininq an inner region of the building structure. The plurality of rafters include a first set of upper rafters and a second set of lower rafters. Each upper and lower rafter has a predetermined location in the building structure to form the upper and lower portions of a roof over the inner region of the building structure.

The building kit also includes means for interconnecting selected building members. The interconnecting means includes a plurality of interconnecting members, each member being formed to include at least one female connector portion in the form of a wedge-shaped slot. The rafters and studs are formed to include at least one integral male connector portion in the form of a wedge configured to mate with selected ones of the female connector portions to interconnect companion pairs of building members. Preferably, each mated pair of male and female connector portions comprises a dovetail joint. Upon interconnection, each building member is fixed in a designated position to form the building structure.

Each stud, rafter, and interconnecting member includes a coded section in close proximity to the respective male or female connector portions. The coded sections of each mated pair cooperate to define a characteristic predetermined pattern on the building members in a region surrounding each of the mated pairs. This configuration provides a visual indication that the building members have been properly interconnected according to a predetermined specification. Typically, each coded section has a predetermined color selected so that the color of the coded section for the male connector portion matches the color of the coded section for the companion female connector portion.

The building structure can also include a door assembly including an outer frame defining an inner region of the door. The door includes an X-shaped member or crossbucks located in the inner region to stabilize the outer frame. The outer frame and X-shaped member are coupled together using integral connector portions formed on selected portions of the X-shaped member and outer frame.

In preferred embodiments, the X-shaped member includes a first diagonal member having a first end and a second end. The diagonal member is formed to include at least one male connector portion extending away from each end. The male connector portions are mated with companion female connector portions formed in the door frame. The X-shaped member also includes two half diagonal members in the shape of a trapezoid having a pair of parallel sides and a pair of nonparallel sides. Both half diagonal members are formed to include at least one male connector portion extending away from the nonparallel sides. The male connector portions of the half diagonal members are mated with companion female connector portions formed in the door frame and the diagonal member to complete the X-shaped member. Each mated pair of male and female connector portions preferably comprises a dovetail joint.

One feature of the present invention is the provision of a kit for the assembly of a building structure to permit rapid assembly according to a predetermined specification. This is accomplished by providing special coding means on the building members themselves to provide a visual indication that various building members have been properly interconnected. A first set of building members is formed to include at least one female connector portion, and a second set is formed to include at least one integral male connector portion. The male connector portions are configured to mate with selected female connector portions to form the building structure. The coding means is situated in close proximity to the male and female connector portions. Coded sections of each mated pair cooperate to define a characteristic predetermined pattern on the building members in a region surrounding each mated pair. This feature advantageously permits the determination by visual inspection of which selected male and female connector portions are to be mated, thereby facilitating assembly of the building structure.

Another feature of the present invention is the provision of a door assembly to be constructed from a plurality of building members formed to include dovetail joints for interconnecting the building members. This feature advantageously insures proper alignment of the building members and permits construction of the door assembly without requiring clamps or nails to interlock adjacent building members.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
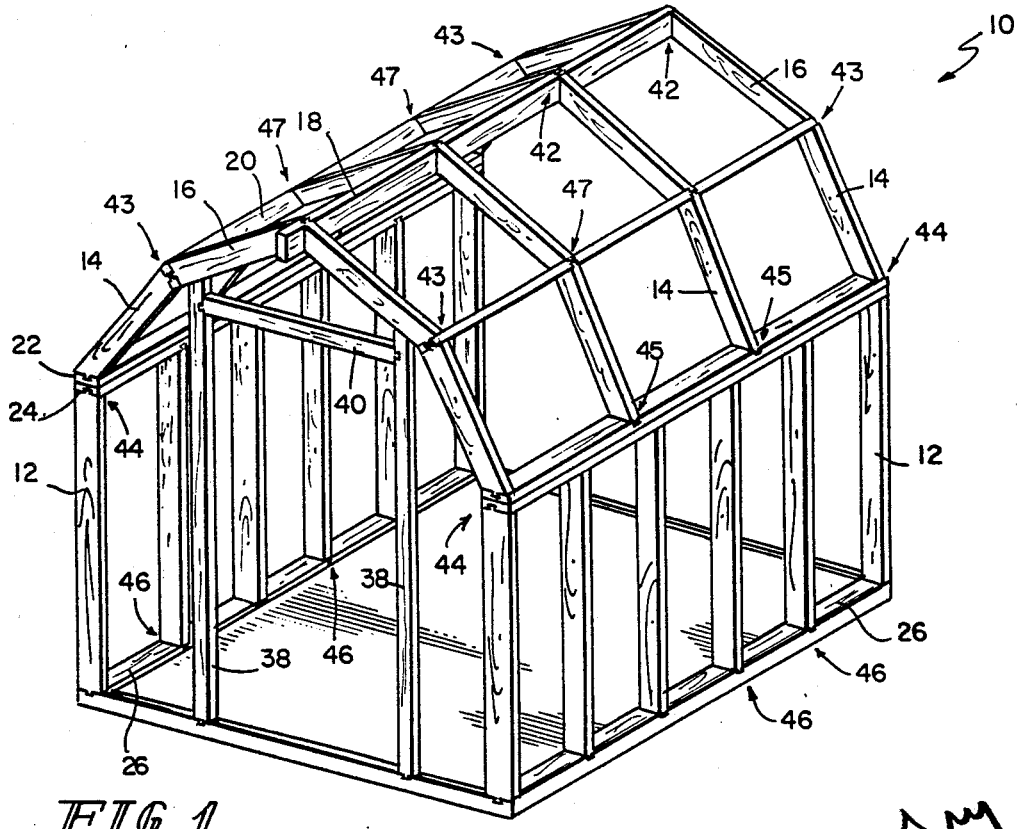
FIG. 1 is a perspective view of a preferred embodiment of a building assembly in accordance with the present invention.

The building assembly 10 shown in FIG. 1 includes a plurality of wall members or studs 12, a plurality of lower roof members or lower rafters 14, and a plurality of upper roof members or upper rafters 16. The studs 12 have a predetermined location to form an inner region of the building structure 10. The rafters 14 and 16 also have a predetermined location to form a roof over the inner region of building structure 10.

As shown in FIGS. 2–5, the studs 12 and rafters 14 and 16 are formed to include male connector portions or wedge portions 28 extending away from each end. The male connector portions 28 are inserted into companion female connector portions or wedge-shaped slots 29 formed in interconnecting members 18, 20, 22, 24, and 26 of the building structure.

Figure 2:
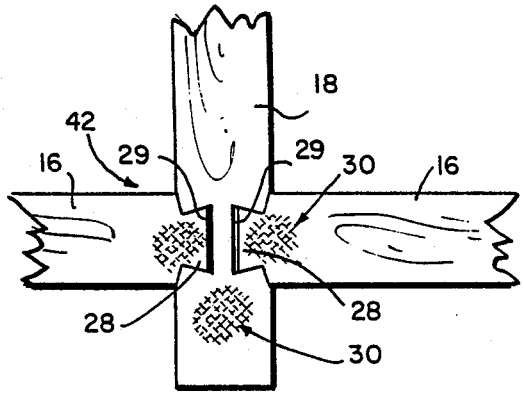
FIG. 2 is a plan view of mated male and female connector portions interconnecting adjacent upper rafters.

Adjacent upper rafters 16 are interconnected by interconnecting member or ridgeboard 18. As illustrated in FIG. 2, the male portions 28 of adjacent upper rafters 16 are mated with female portions 29 of ridgeboard 18. This joint arrangement is used at four positions 42 across the peak of the roof.

Figure 3:
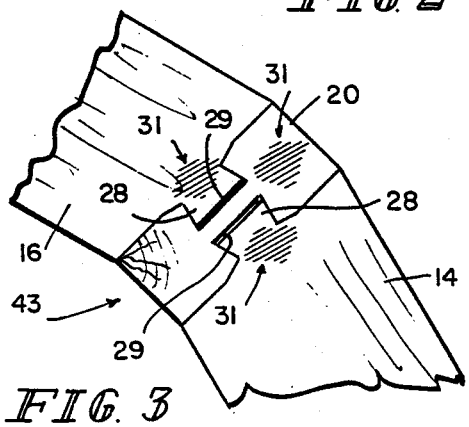
FIG. 3 is a front elevational view of mated male and female connector portions interconnecting upper and lower rafters.

Adjacent upper and lower rafters 16 and 14 are connected as shown in FIG. 3 at location 43. Male connector portions 28 of lower rafter 14 and upper rafter 16 are mated with female connector portions 29 of interconnecting member 20. This joint is used in four locations 43, as shown in FIG. 1.

Figure 4:
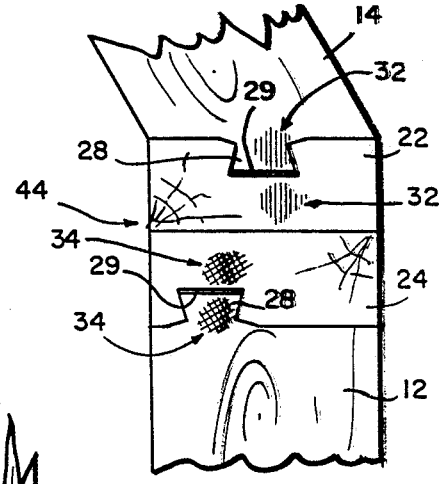
FIG. 4 is a front elevational view of mated male and female connector portions interconnecting lower rafters and studs.

Lower rafters 14 are interconnected with studs 12 by interconnecting members 22 and 24. As best shown in FIG. 4 at location 44, the male portion 28 of lower rafter 14 is mated with female connector portion 29 formed in interconnecting member 22. The male portion 28 of stud 12 is mated with the female connector portion of interconnecting member 24. Interconnecting member 22 can be connected to interconnecting member 24 by any suitable means such as gluing or nailing the interconnecting members together. There are four similar joints at locations 44 shown in FIG. 1.

Figure 5:
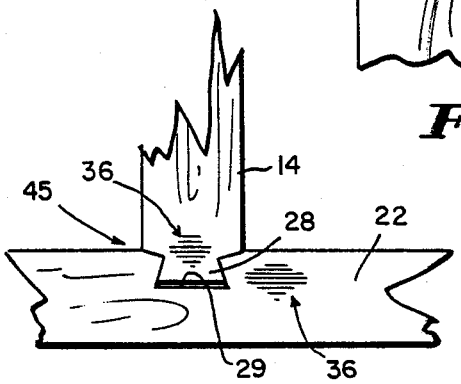
FIG. 5 is a side elevational view of another mated pair of male and female connector portions.

The joints used to connect lower rafters 14 to interconnecting member 22 at locations 45 is illustrated in FIG. 5. The male connector portion 28 of lower rafter 14 is mated with female connector portion 29 of interconnecting member 22.

Each stud 12 is coupled to the base or bottom plate 26 at joint locations 46. The joint used at location 46 is similar to the joint shown in FIG. 5. The male connector portion on stud 12 is mated with a female connector portion formed in base 26. The joint connecting upper rafters 16 and lower rafters 14 at locations 47 are similar to the joints illustrated in FIG. 2.

Each building member includes a coded section located in close proximity to the mated pairs of male and female connector portions. The coded sections near each mated pair cooperate to define a characteristic predetermined pattern on the building members in a region surrounding each mated pair to provide a visual indication that the building members have been properly interconnected according to a predetermined specification. In the preferred embodiment, each coded section has a predetermined color selected so that, for each mated pair of male and female connector portions, the color of the coded section for the male connector portion matches the color of the coded section for the female connector portion.

As shown in FIG. 2, a selected color code 30 on ridgeboard 18 is located in close proximity to female connector portions 29. A matching color 30 is located in close proximity to male connector portions 28 on adjacent upper rafters 16.

Another selected color 31 is situated in close proximity to female connector portions 29 of interconnecting member 20 as shown in FIG. 3. A matching color 31 is located on upper rafter 16 and lower rafter 14 in close proximity to male connector portions 28.

As shown in FIG. 4, color coding is also located on the interconnecting region between studs 12 and rafters 14. A certain selected color 32, different from colors 30 or 31, is located on interconnecting member 22 in close proximity to female connector portion 29. A matching color 32 is located on lower rafter 14 in close proximity to male connector portion 28. Another selected color 34 is located on interconnecting member 24 in close proximity to female connector portion 29. A matching color 34 is located in close proximity to male connector portion 28 on stud 12.

Yet another selected color 36, as illustrated in FIG. 5, is located in close proximity to female connection portion 29 on interconnecting member 22. A matching selected color 36 is located in close proximity to male connector portion 28 on lower rafter 14.

After the male connector portions 28 of each stud 12, lower rafter 14, and upper rafter 16 are arranged in a mating engagement with their companion female connector portions 29 according to the color coding scheme, each building member occupies a designated position to form the building structure. A door frame is then installed including two substantially parallel side frame members or door bucks 38 coupled between upper rafters 16 and base 26. A top door frame member 40 is coupled between opposite door bucks 38 in close proximity to the upper rafters 16.

Figure 6:
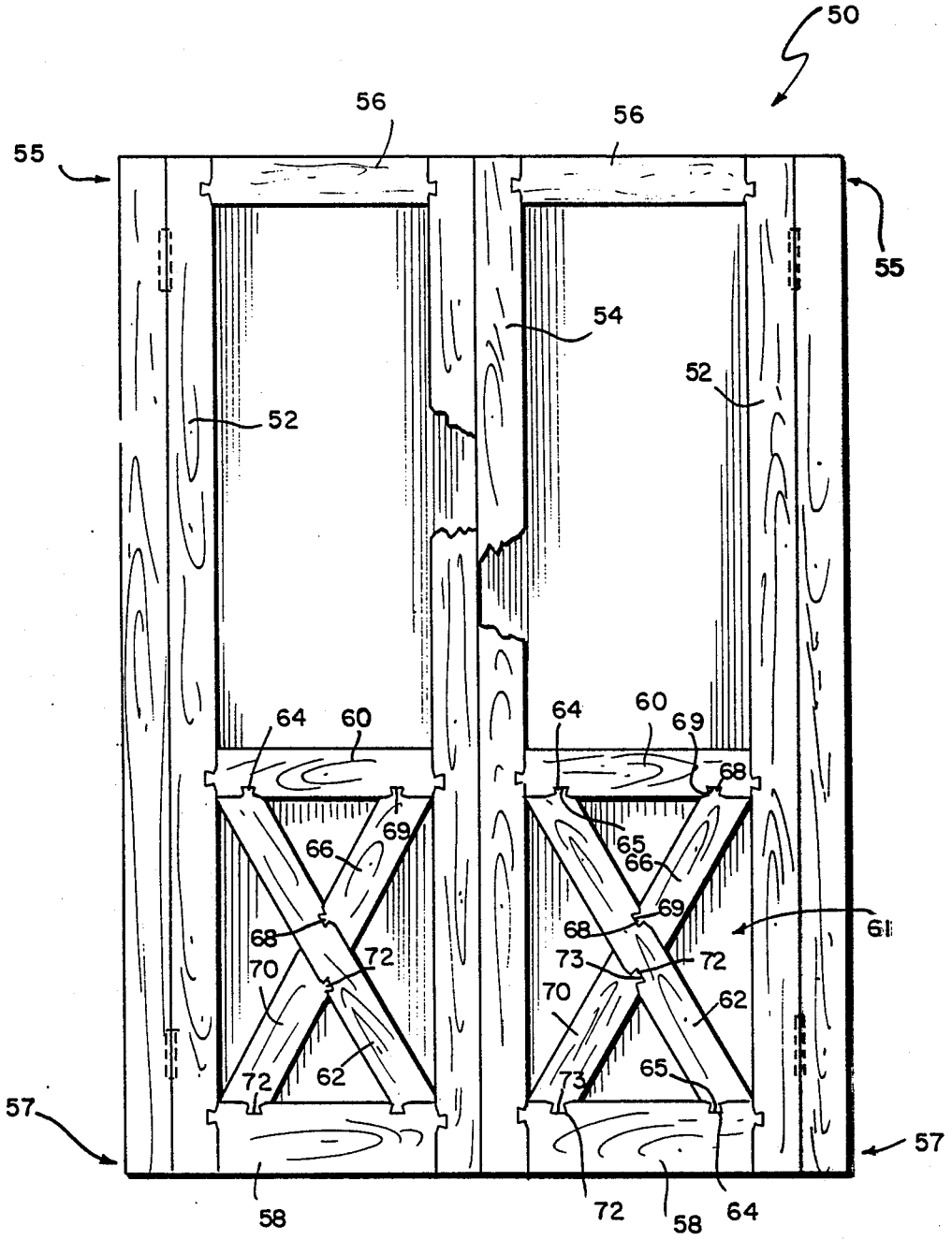
FIG. 6 is an elevational view of a door assembly, with portions broken away, in accordance with the present invention.

As shown in FIG. 6, a door assembly 50 can be included for use with the building kit. The door assembly includes an outer frame having a first side member 52 and a second side member 54 substantially parallel to first side member 52. First side member 52 and second side member 54 have an upper end 55 and a lower end 57. A top frame member 56 is coupled between first side member 52 and second side member 54 in close proximity to upper end 55. A bottom frame member 58 is coupled between the first side member 52 and the second side member 54 in close proximity to lower end 57 so that bottom member 58 is substantially parallel to top member 56. A center frame member 60, substantiallly parallel to top member 56 and bottom member 58, is coupled between the first side member 52 and the second side member 54 in a spaced apart relation to upper end 55 and lower end 57.

An X-shaped member or crossbuck 61 is coupled between center member 60 and bottom frame member 58 to stabilize the door. The X-shaped member includes a diagonal portion 62 having the shape of a parallelogram. Diagonal portion 62 includes male connector portions 64 extending away from the shorter length parallel sides of diagonal member 62. Male connector portions 64 are inserted into female connector portions 65 formed in center member 60 and bottom member 58, thereby securing diagonal member 62 to the outer frame.

The X-shaped member also includes two half diagonal members 66, 70 shaped in the form of a trapezoid having two parallel sides and two nonparallel sides. The half diagonal members 66 and 70 are coupled to diagonal member 62 and the frame to complete the X-shaped portion. Half diagonal member 66 includes male connector portions 68 extending away from the nonparallel sides. Male connector portions 68 are mated with the female portions 69 formed in center member 60 and diagonal member 62. Half diagonal member 70 includes male connector portions 72 extending away from the nonparallel sides. Male connector portions 72 are mated with female connector portions 73 formed in bottom member 58 and diagonal member 73.

In preferred embodiments of the present invention, each mated pair of male and female connector portions in the door assembly comprises a dovetail joint. After the outer frame and X-shaped member have been assembled, a sheet of plywood or other suitable material is attached to the frame to complete the door.

Although the invention has been described in detail with reference to a certain Preferred embodiment, variations and modifications exist within the scope and spirit of the invention as described and defined in the following claims:

What is claimed is:

1. A kit for the assembly of a building structure, the kit comprising:

a plurality of precut building members, each building member having end portions configured to abut adjacent building members to form a building structure, each building member having a predetermined position relative to the remaining building members in the building structure; and coding means located on an exterior surface of the end portion of each of the building members for indicating the predetermined position of each building member so that selected building members to be interconnected can be determined by visual inspection to facilitate the assembly of the building structure, wherein the plurality or precut building members includes a plurality of side boards to forms four outer walls including two end walls and two side walls, for defining an inner region of the building structure, the building members also including a plurality of roof boards to form a roof over the inner region and a plurality of base boards to form a foundation for the structure, and the end portions includes means for permitting interconnection of adjacent pairs of building members having male connector portions and female connector portions formed on selected building members to permit interconnection of the side boards with both the roof boards and baseboards by mating selected male and female portions, where the ends of the roof boards are connected adjacent the ends of the side boards, the coding means being located in close proximity to the male and female portions to provide a visual indication of which male and female portions should be mated to form the building structure.

2. The kit of claim 1, wherein the coding means includes selected colors placed on the plurality of side boards and the plurality of roof boards in a coded pattern to indicate which male and female portions are to be mated so that upon assembly of the building structure each board is in its predetermined position relative to the other boards.

3. The kit of claim 1, wherein each male connector portion includes a male wedge portion and each female connector portion includes a wedge-shaped slot configured to be mated with a predetermined male wedge portion, and each mated pair of male wedge portions and wedge-shaped slots together form a dovetail joint.

* * * * *